US007107967B2

(12) United States Patent
Sano

(10) Patent No.: US 7,107,967 B2
(45) Date of Patent: Sep. 19, 2006

(54) FUEL SUPPLY PUMP HAVING INNER LUBRICATING GROOVE

(75) Inventor: Atsushi Sano, Nagoya (JP)

(73) Assignee: Denso Corporation, Kariya (JP)

( * ) Notice: Subject to any disclaimer, the term of this patent is extended or adjusted under 35 U.S.C. 154(b) by 137 days.

(21) Appl. No.: 11/007,354

(22) Filed: Dec. 9, 2004

(65) Prior Publication Data

US 2005/0129532 A1 Jun. 16, 2005

(30) Foreign Application Priority Data

Dec. 15, 2003 (JP) ..... 2003-416704

(51) Int. Cl.
*F02M 37/04* (2006.01)

(52) U.S. Cl. ..... 123/450; 417/366

(58) Field of Classification Search ..... 123/450, 123/495; 417/366

See application file for complete search history.

(56) References Cited

U.S. PATENT DOCUMENTS 3,682,572 A * 8/1972 Yarger ..... 417/273
4,492,545 A * 1/1985 Mochizuki et al. ..... 418/149
5,273,408 A * 12/1993 Yuge ..... 418/30
6,158,980 A * 12/2000 Tsumagari et al. ..... 417/366
6,241,484 B1 * 6/2001 Hiltemann ..... 417/273
6,345,609 B1 * 2/2002 Djordjevic ..... 123/509
6,503,068 B1 * 1/2003 Kojima et al. ..... 418/30
6,615,799 B1 * 9/2003 Mori et al. ..... 123/450
6,722,864 B1 * 4/2004 Suzuki et al. ..... 417/470
2003/0108443 A1 * 6/2003 Suzuki et al. ..... 417/470

FOREIGN PATENT DOCUMENTS

JP 2-99757 4/1990

* cited by examiner

*Primary Examiner*—Thomas Moulis
(74) *Attorney, Agent, or Firm*—Nixon & Vanderhye P.C.

(57) ABSTRACT

A fuel supply pump includes a housing, a camshaft and a cam ring. The camshaft is rotatably supported in the housing. The cam ring is supported around a cam portion of the camshaft such that the cam ring is rotatable with respect to the cam portion. A washer member is provided between an axial end face of the cam portion and the housing, so that the cam portion and the camshaft is axially aligned. A bearing is circumferentially inserted between the end face of the cam portion and the cam ring. An axial end face of the cam ring defines oil grooves, so that lubricating oil flows from a cam chamber into a gap, which is formed between the cam portion and the bearing. Lubricating oil is sufficiently supplied to the periphery of the cam portion, so that the camshaft can be protected from seizure in the fuel supply pump.

7 Claims, 6 Drawing Sheets

FUEL SUPPLY PUMP HAVING INNER LUBRICATING GROOVE

CROSS REFERENCE TO RELATED APPLICATIONS

This application is based on and incorporates herein by reference Japanese Patent Application No. 2003-416704 filed on Dec. 15, 2003.

FIELD OF THE INVENTION

The present invention relates to a fuel supply pump that for a common-rail type fuel injecting apparatus that is provided between a fuel tank and a fuel injecting apparatus to supply high-pressure fuel to the fuel injecting apparatus.

BACKGROUND OF THE INVENTION

A fuel supply pump compresses fuel fed from a fuel tank, and pressurizes the fuel, so that the pressurized fuel is supplied to a fuel injecting apparatus. In a conventional fuel supply pump disclosed in JP-A-2002-310039 shown in FIG. 9, a fuel supply pump 50 has a camshaft 54, a cam ring 55 and a plunger 56. The camshaft 54 is rotatably arranged in a housing 51. The camshaft 54 has a cam portion 542. The cam ring 55 is rotatably arranged on the outer periphery of the cam portion 542 such that the cam ring 55 is rotatable with respect to the cam portion 542, so that the cam ring 55 vertically reciprocates. The plunger 56 connects with the cam ring 55 such that the plunger 56 vertically reciprocates in conjunction with the cam ring 55. The end portion of the plunger 56, which is opposite to the connecting portion between the plunger 56 and the cam ring 55, is inserted into a pressure chamber 52, into which high-pressure fuel is introduced. When the plunger 56 reaches the top dead center of the plunger 56, fuel introduced into the pressure chamber 52 is pressurized, and the pressurized fuel is supplied to the fuel injecting apparatus.

The outer circumferential periphery of the cam portion 542 defines an oil groove 543. Low-pressure oil, which flows into a cam chamber 53, is introduced into the oil groove 543 as lubricating oil. The lubricating oil is entirely distributed from the oil groove 543 to the outer circumferential periphery of the cam portion 542. Thus, seizure between the cam portion 542 and the cam ring 55 is restricted.

In the conventional fuel supply pump 50, washer members 60 are respectively provided between the axial end faces of the cam ring 55 and flat faces of the housing 51 that oppose to the axial end faces of the cam portion 542. Each washer member 60 aligns the camshaft 54 in the axial direction. In this structure, clearance, which is formed between each axial end face of the cam ring 55 and the opposing axial end face of the corresponding washer member 60, is formed to be small. When the clearance is small, an amount of lubricating oil introduced from the cam chamber 53 into the clearance becomes small, and the lubricating oil may not be entirely distributed over the outer circumferential periphery of the cam portion 542. In this case, seizure may occur and the fuel supply pump 50 may be damaged.

SUMMARY OF THE INVENTION

In view of the foregoing problems, it is an object of the present invention to produce a fuel supply pump that has a structure, in which lubricating oil can be sufficiently introduced to a rotating members to protect the rotating members from seizure.

According to claim 1, a fuel supply pump is provided between a fuel tank and a fuel injecting apparatus. The fuel supply pump supplies fuel, which is fed from the fuel tank, to the fuel injecting apparatus. The fuel supply pump includes a housing, a camshaft, and a cam ring. The housing defines a cam chamber such that lubricating oil is supplied from the cam chamber. The camshaft is rotatably supported in the housing. The camshaft includes a cam portion that rotates in the cam chamber. The cam ring is rotatably connected with the camshaft.

The cam ring has an axial end portion that defines an oil groove that communicates the cam chamber with a gap, which is substantially circumferentially defined between the cam portion and the cam ring. Thus, lubricating oil is capable of flowing from the cam chamber into the gap, which is substantially circumferentially defined between the cam portion and the cam ring, through the oil groove.

Alternatively, the housing has a face that opposes to an axial end portion of the cam portion in the substantially axial direction of the camshaft. The face of the housing defines an oil groove that communicates the cam chamber with a gap, which is substantially circumferentially defined between the cam portion and the cam ring. Thus, lubricating oil is capable of flowing from the cam chamber into the gap, which is substantially circumferentially defined between the cam portion and the cam ring, through the oil groove.

Alternatively, the washer member defines an oil groove that communicates the cam chamber with a gap, which is substantially circumferentially defined between the cam portion and the cam ring. Lubricating oil is capable of flowing from the cam chamber into the gap, which is substantially circumferentially defined between the cam portion and the cam ring, through the oil groove.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS (First Embodiment)

Figure 1:
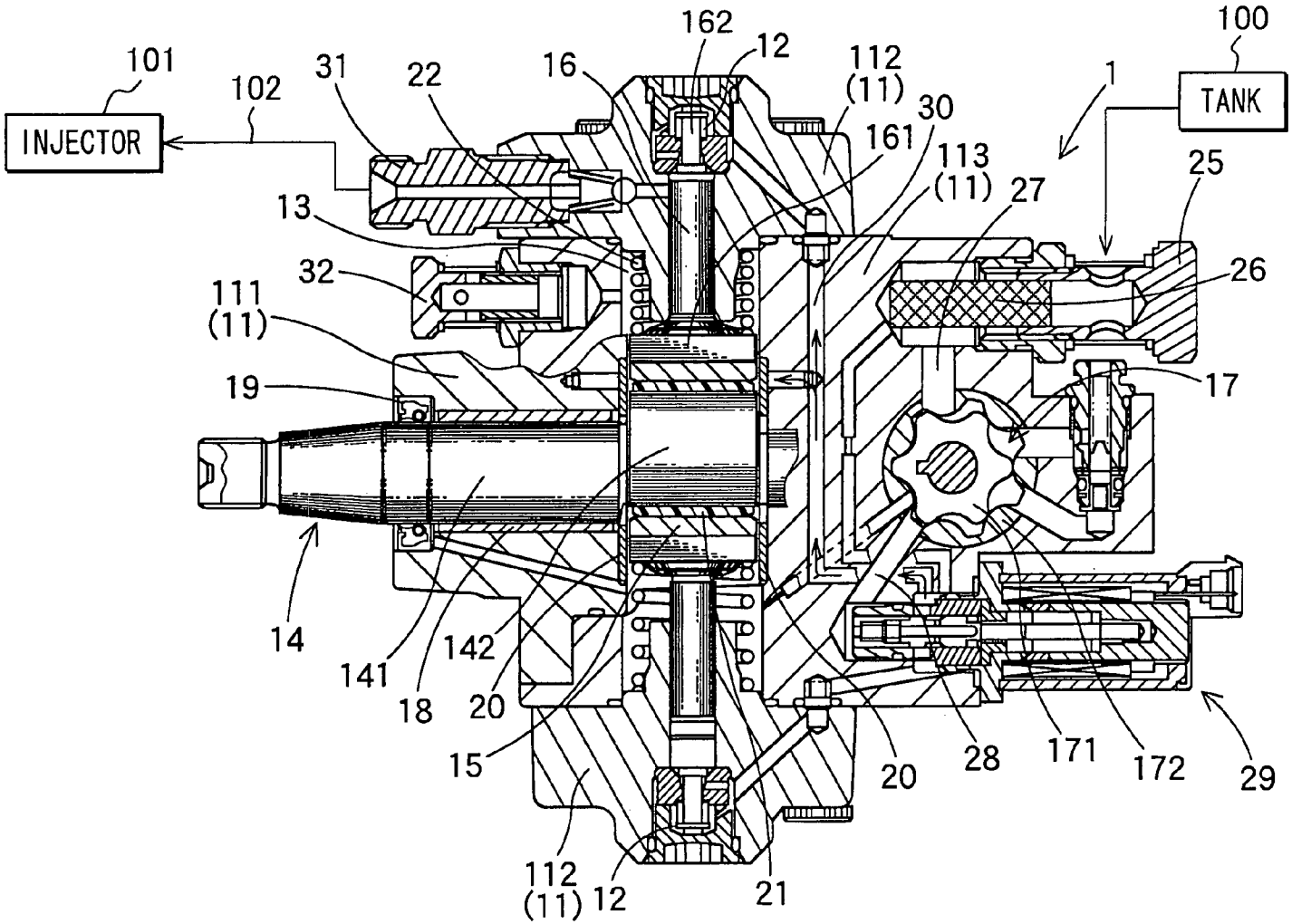
FIG. 1 is a partially cross sectional front view showing a fuel supply pump according to a first embodiment of the present invention.

As shown in FIG. 1, a fuel supply pump 1 feeds fuel from a fuel tank 100 to supply high-pressure fuel into a fuel injecting apparatus 101 through a common rail 102 in a common-rail type (pressure accumulating type) fuel injecting apparatus. However, the structure of the present invention can be applied to any other type of a fuel supply pump.

The fuel supply pump 1 has a housing 11 that is constructed of a first housing 111, multiple second housings 112, and a third housing 113. The first housing 111 rotatably supports a camshaft 14. Each second housing 112 internally forms a pressure chamber 12. The third housing 113 is secured to the first housing 111, so that the first, second and third housings 111, 112, 113 form a cam chamber 13 thereamong.

The camshaft 14 has a shaft portion 141 and a cam portion 142. The shaft portion 141 is rotatably supported by the first housing 111. The cam portion 142 rotates around the rotation center of the cam portion 142 that is eccentric with respect to the rotation center of the shaft portion 141. A cam ring 15 and a plunger 16 are arranged around the cam portion 142. The cam ring 15 is rotatably supported by the cam portion 142. The plunger 16 is capable of reciprocate in conjunction with the cam ring 15. A pulley (not shown) is provided to one axial end of the camshaft 14. The pulley is connected with a crankshaft of an engine (not shown) via a transmitting device such as a belt (not shown). A feed pump 17 is provided to the other axial end of the camshaft 14. The feed pump 17 rotates in conjunction with the camshaft 14.

The number of the second housings 112 depends on the number of the plungers 16. In the first embodiment, two of the plungers 16 are received in two of the second housings 112.

In FIG. 1, the feed pump 17 is shown by a side view in the fuel supply pump 1 that is shown by a front view excluding the feed pump 17 and a peripheral portion of the feed pump 17. Specifically, the feed pump 17 is shown in a condition, in which the feed pump 17 is rotated by 90° horizontally in FIG. 1 with respect to the face of the paper. The feed pump 17 is shown by a side view for convenience in the following description. Originally, a shaft portion, which is a rotation center of the feed pump 17, is on an extension of the shaft portion 141 of the camshaft 14 shown by a dotted line in FIG. 1. Originally, the shaft portion of the feed pump 17 is supposed to be shown by a partially cross-sectional front view. However, the feed pump 17 and the peripheral portion of the fuel feed pump 17 are shown by the side view for explanation of fuel flow.

Furthermore, the camshaft 14 is rotatably supported by the first housing 111 via a bearing 18. An oil seal 19 is arranged between one side of the shaft portion 141 and the first housing 111. The oil seal 19 is arranged side by side with the bearing 18. The axial end faces of the cam portion 142 are restricted by washer members 20 from axially moving. Each washer member 20 is provided axially between the axial end face of the cam portion 142 and the first housing 111. The washer member 20 is provided axially between the axial end face, i.e., an axial end portion 142*a* (FIG. 2) of the cam portion 142 and the third housing 113. Thus, the camshaft 14 is aligned in the axial direction of the camshaft 14. The washer members 20 are arranged on both axial end portions of the cam portion 142 such that the washer members 20 are loosely connected to the shaft portions 141 of the camshaft 14. The washer members 20 and the cam portion 142 form gaps in the axial direction thereamong, so that oil can pass through the gaps.

Figure 2:
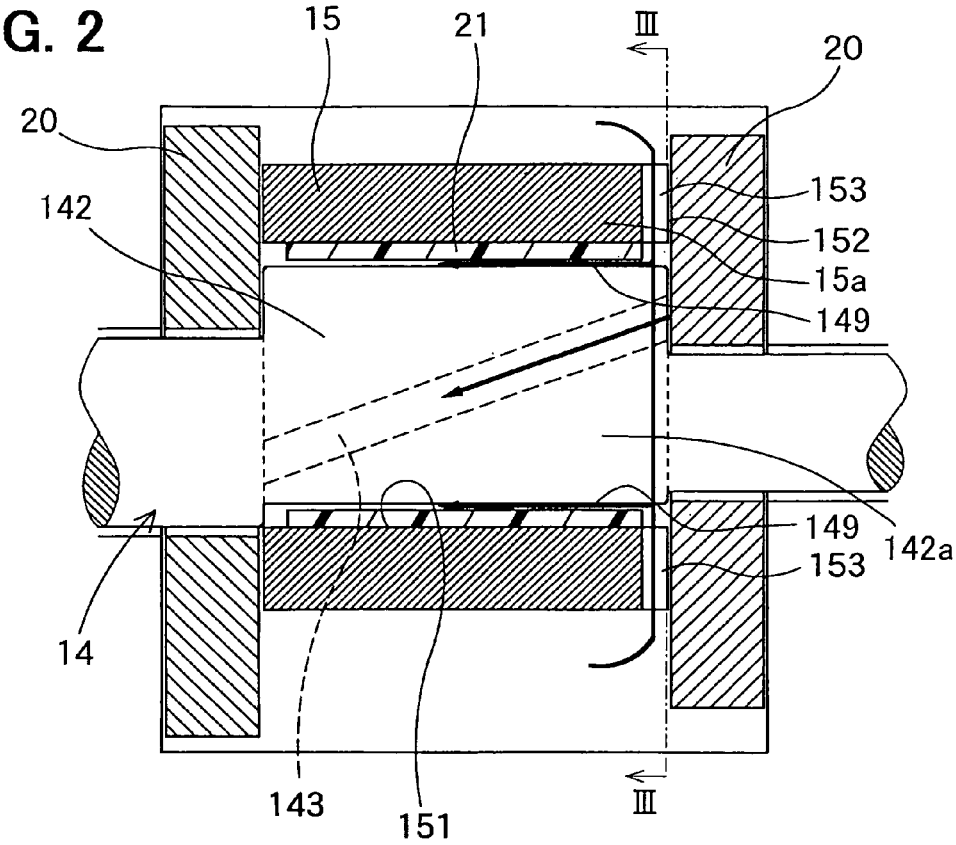
FIG. 2 is a partially cross-sectional front view showing a cam portion and a cam ring according to the first embodiment.
Figure 3:
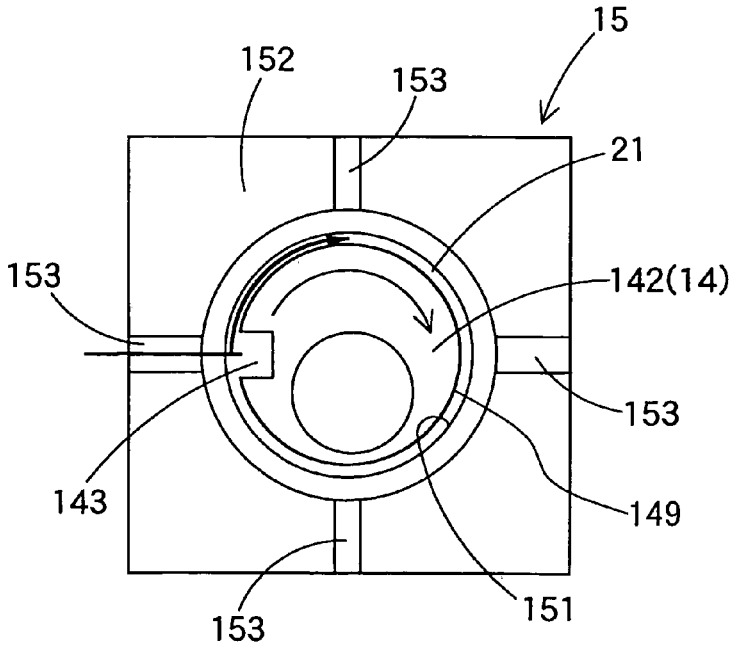
FIG. 3 is a side view showing oil grooves defined in the cam ring taken along with the line III—III in FIG. 2 according to the first embodiment.

As shown in FIGS. 2, 3, the cam ring 15 is formed in a rectangular shape (FIG. 3), which has a hole portion 151, through which the cam portion 142 of the camshaft 14 axially penetrates. The cam ring 15 and the cam portion 142 radially insert into a bearing 21 therebetween, so that the cam ring 15 engages with the bearing 21, and the cam ring 15 is rotatable with respect to the outer circumferential periphery of the cam portion 142. The plungers 16 (FIG. 1) are respectively connected with both the upper and lower faces of the cam ring 15 by plane-to-plane contact.

Each plunger 16 has a plane receiving portion 161, in which the plunger 16 is connected with the cam ring 15 on one axial end portion of the plunger. Specifically, the axial end face of the plane receiving portion 161 of the plunger 16 contacts with the radially outer flat end face of the cam ring 15. The plunger 16 has a pin portion 162 on the other end portion of the plunger 16. The pin portion 162 of the plunger 16 is inserted into the pressure chamber 12. The plunger 16 is urged by a coil spring 22, which is outwardly provided around the plunger 16, to the side of the cam ring 15. The coil spring 22 is circumferentially surround the second housing 112. The camshaft 14 rotates, so that the cam portion 142 rotates, and the cam ring 14 vertically reciprocates in FIG. 1. Thus, the plunger 16 pressurizes low-pressure fuel, which is introduced into the pressure chamber 12, in conjunction with the cam ring 15.

The feed pump 17 is rotatably supported in the third housing 113. The feed pump 17 has an inner rotor 171 and an outer rotor 172, such that fuel introduced from an inlet (supply port) 25 to an inlet passage 27 through a filter 26 is transferred to a flow control valve 29 through an outlet passage 28. The flow control valve 29 is communicated with the pressure chamber 12 and the cam chamber 13 through a circulation passage 30.

A fuel outlet port (outlet) 31 communicates with the pressure chamber 12. A leak valve 32 communicates with the cam chamber 13. Supplied fuel is pressurized in the pressure chamber 12, and fed into the fuel injecting apparatus 101. Fuel fed into the cam chamber 13 serves as lubricating oil for lubrication of rotating portion of the camshaft 14.

Fuel (lubricating oil) accumulating in the cam chamber 13 is sufficiently supplied into the rotating portion, i.e., the gap 149 (FIG. 2) circumferentially formed between the cam portion 142 of the camshaft 14 and the bearing 21 that engage with each other. When the bearing 21 is not provided, fuel (lubricating oil) is supplied into a gap formed between the outer circumferential periphery of the cam portion 142 and the inner circumferential periphery of the cam ring 15 that engage with each other to lubricate therebetween. The structure, in which the bearing 21 is provided, is explained in the following description.

As shown in FIGS. 2, 3, the fuel passage, which introduces from the cam chamber 13 to the cam portion 142, has oil grooves 153, in which lubricating oil passes, defined on the side of an axial end face 152 of the cam ring 15 in the first embodiment. That is, the oil grooves 153 are defined in the axial end portion 15*a* of the cam ring 15.

As shown in FIG. 3, the oil grooves 153 are defined to be in a shape of a cross in the axial end face of the cam ring 15, which axially oppose to the washer member 20, with respect to the center of the hole portion 151. The cam portion 142 penetrates through the hole portion 151 of the cam ring 15. That is, linear grooves are defined on the end face of the cam ring 15, which is formed in the rectangular shape in the side view of the cam ring 15. The linear grooves 153 are defined from the outer circumferential periphery of the cam ring 15 to the center of the hole portion 15 of the cam ring 15. The outer circumferential periphery of the cam portion 142 of the camshaft 14 partially defines an oil groove 143 substantially along the axial direction of the camshaft 14. The oil groove 143 is slanted with respect to the axial center of the camshaft 14.

The oil grooves 153 need not to be a groove oriented to the center of the hole portion 151, as long as the oil grooves 153 are oriented from the outer circumferential periphery of the cam ring 15 to the hole portion 151 of the cam ring 15. The oil grooves 153 need not to be in a linear shape, and the oil grooves 153 may be in a curved shape or a zigzag shape. An amount of lubricating oil passing through the oil grooves 153 is significantly larger than an amount of lubricating oil passing through the gaps formed between the axial end faces 152 of the cam ring 15 and the washer members 20 on both axial sides of the cam ring 15.

The bearing 21 is arranged radially between the cam ring 15 and the cam portion 142. In general, the bearing 21 is press-inserted along the inner circumferential periphery of the cam ring 15, so that lubricating oil is supplied into the gap 149 formed between the outer circumferential periphery of the cam portion 142 and the inner circumferential periphery of the bearing 21. Therefore, lubricating oil is supplied from the gap 149 formed between the outer circumferential periphery of the cam portion 142 and the inner circumferential periphery of the bearing 21 into the oil groove 143 formed in the outer circumferential periphery of the cam portion 142 by rotation of the camshaft 14. Thus, the lubricating oil is entirely distributed over the outer circumferential periphery of the cam portion 142.

Next, an operation of the fuel supply pump 1 having the above structure is described.

As referred in FIG. 1, the fuel supply pump 1 is arranged between the fuel tank 100 and the fuel injecting apparatus 101. Specifically, the fuel supply pump 1 has a structure such that the fuel supply pump 1 feeds high-pressure fuel into the common rail 102 that is a pressure-accumulating and fuel distributing apparatus.

Fuel supplied from the fuel tank 100 is introduced from the inlet 25 of the fuel supply pump 1. The fuel introduced from the inlet 25 passes through the filter 26. Dust and debris are removed from the fuel, while the fuel passes through the filter 26, and the fuel flows into the feed pump 17 through the inlet passage 27 in the fuel supply pump 1.

The fuel introduced from the inlet passage 27 flows into the gap formed between the inner rotor 171 and the outer rotor 172 in the feed pump 17, so that the fuel flowing into the gap moves by rotation of the inner rotor 171 and the outer rotor 172, and the fuel is transferred to the outlet passage 28.

The fuel transferred into the outlet passage 28 flows into the flow control valve 29, so that pressure of the fuel is controlled at a predetermined pressure, and the fuel is transferred as low-pressure fuel. The low-pressure fuel is transferred partially into each pressure chamber 12 in each second housing 112, and rest of the low-pressure fuel is supplied into the cam chamber 13, through the circulation passage 30.

The low-pressure fuel introduced into the pressure chamber 12 is pressurized by reciprocating motion of the plunger 16 in conjunction with the cam ring 15. The reciprocating motion of the plunger 16 is generated by eccentric rotation of the cam portion 142 of the camshaft 14. The low-pressure fuel is pressurized to be high-pressure fuel in the pressure chamber 12, and the high-pressure fuel is transferred into the fuel injecting apparatus 101 through the common rail 102.

The rest of the low-pressure fuel transferred into the cam chamber 13 is introduced into a rotating sliding portion of the camshaft 14 as lubricating oil to lubricate the rotating sliding portion. That is, as shown in FIGS. 2, 3, lubricating oil accumulated in the cam chamber 13 is introduced into the gap 149 formed between the outer circumferential periphery of the cam portion 142 of the camshaft 14 and the inner circumferential periphery of the bearing 21 through the oil grooves 153 defined in the axial end face 152 of the cam ring 15. The lubricating oil is partially introduced to the outer circumferential periphery of the shaft portion 141 of the camshaft 14, and is transferred into the gap formed between the shaft portion 141 of the camshaft 14 and the bearing 18 that engage with each other, so that lubricating performance on the periphery of the shaft portion 141 is improved.

Lubricating oil flows from the gap 149 formed between the cam portion 142 and the bearing 21, which engage with each other, into the oil groove 143 defined in the cam portion 142, so that the lubricating oil is distributed entirely over the outer circumferential periphery of the cam portion 142 by rotation of the cam portion 142. Thus, lubrication can be sufficiently performed in the periphery of the cam portion 142.

The oil grooves 153 are defined in the axial end face 152 of the cam ring 15. The cam ring 15 engages with the cam portion 142 of the camshaft 14 such that the cam ring 15 is rotatable with respect to the cam portion 142. The oil grooves 153 are defined from the cam chamber 13 to the gap 149 formed between the cam portion 142 and the bearing 21, so that lubricating oil can be sufficiently supplied to the periphery of the cam portion 142 in the fuel supply pump 1 of the first embodiment. Thus, the periphery of the cam portion 142 can be restricted from seizure, so that durability of the fuel supply pump 1 can be enhanced.

Here, the oil grooves 153 may be defined in either of the axial end faces of the cam ring 15, and the oil grooves 153 may be defined in both the axial end faces of the cam ring 15.

(Second Embodiment)

Figure 4:
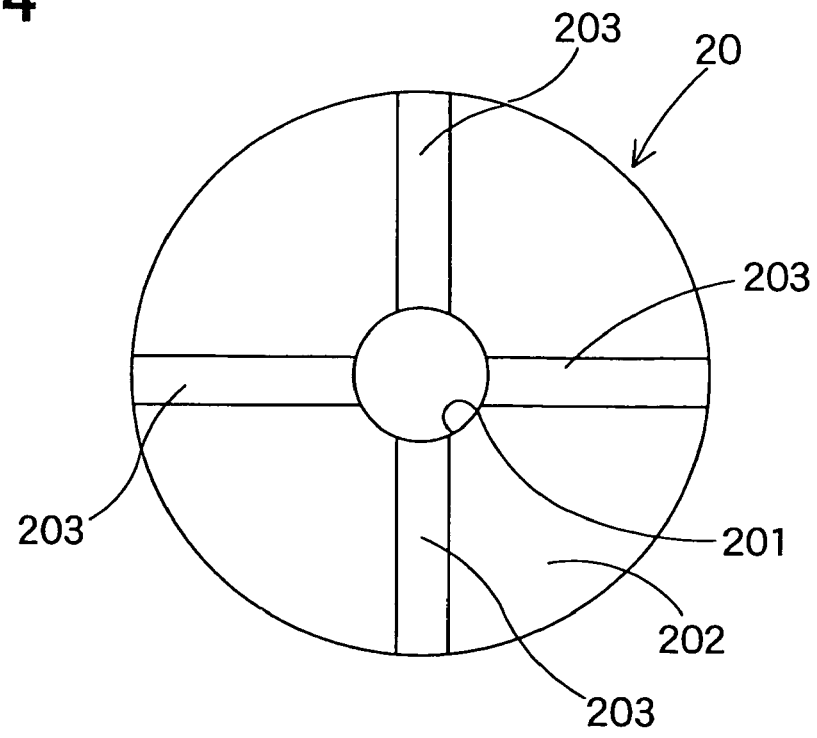
FIG. 4 is a side view showing oil grooves defined in a washer member according to a second embodiment of the present invention.
Figure 5:
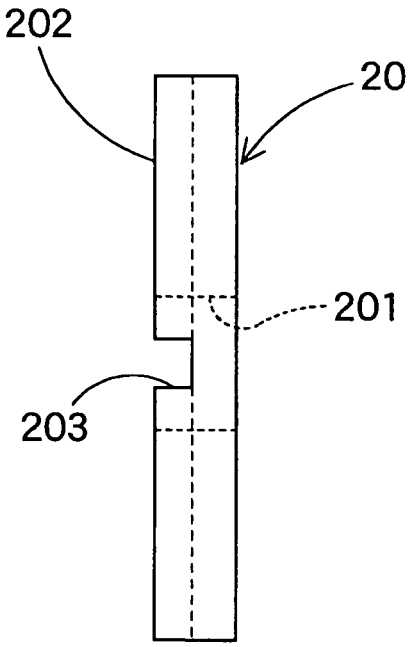
FIG. 5 is a front view showing the oil grooves of the washer member according to the second embodiment.
Figure 6:
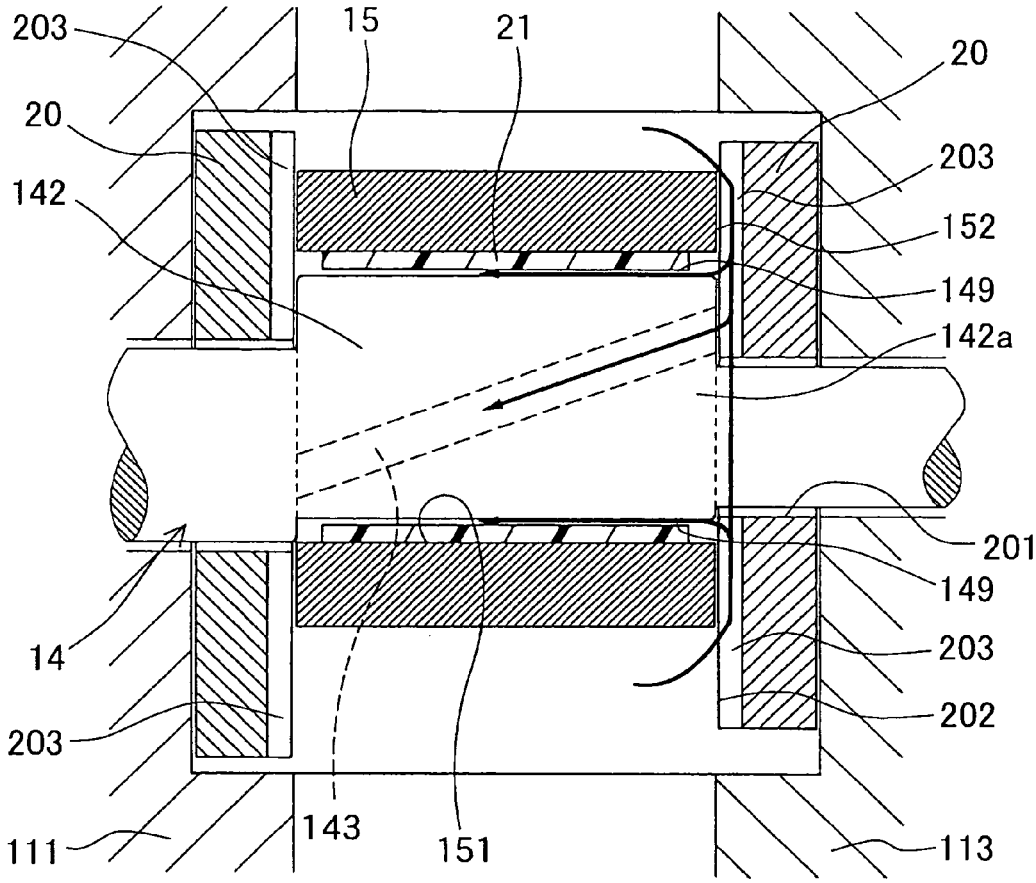
FIG. 6 is a partially cross-sectional front view showing the washer member, the cam portion and a cam ring according to the second embodiment.

As shown in FIGS. 4 to 6, a hole portion 201 is defined in the center of the washer member 20 such that the shaft portion 141 of the camshaft 14 penetrates through the hole portion 201. The washer member 20 is assembled to the shaft portion 141 of the camshaft 14, so that cross-shaped oil grooves 203 (FIG. 4) are formed in a face 202 of the washer member 20 with respect to the center axis of the washer member 20. The face 202 of the washer member 20 axially opposes to the axial end face, i.e., an axial end portion 142*a* (FIG. 6) of the cam portion 142 or the cam ring 15. The oil grooves 153, which are defined in the axial end face 152 of the cam ring 15 described in the first embodiment, need not to be defined, as long as the oil grooves 203 are defined in the washer member 20. However, the oil grooves 153 may be defined in the axial end face 152 of the cam ring 15. Here, the oil grooves 203 may be defined in either of the washer members 20, and the oil grooves 203 may be defined in both the washer members 20.

Lubricating oil accumulated in the cam chamber 13 is introduced into the gap 149, which is formed between the outer circumferential periphery of the cam portion 142 of the camshaft 14 and the inner circumferential periphery of the bearing 21 that engage with each other, through the oil grooves 203 defined in the washer member 20. The lubricating oil is supplied into the oil groove 143 of the cam portion 142 in the same manner as described in the first embodiment. Lubricating oil in the oil groove 143 of the cam portion 142 is distributed entirely to the outer circumferential periphery of the cam portion 142 by rotation of the cam portion 142, so that lubrication can be further improved.

The oil grooves 203 defined in the washer 20 are significantly larger than the axial clearance formed between the axial end face 152 of the cam ring 15 and the washer member 20. Lubricating oil flowing from the cam chamber 13 is sufficiently supplied to the outer circumferential periphery of the cam portion 142 of the camshaft 14 through the oil grooves 203. Lubricating oil supplied into the oil grooves 203 is brought to the gap (engagement gap) 149 between the cam portion 142 and the cam ring 15, as the cam portion 142 of the camshaft 14 rotates. Therefore, seizure may not occur in the periphery of the cam portion 142, so that the fuel supply pump can be protected from seizure.

(Third Embodiment)

Figure 7:
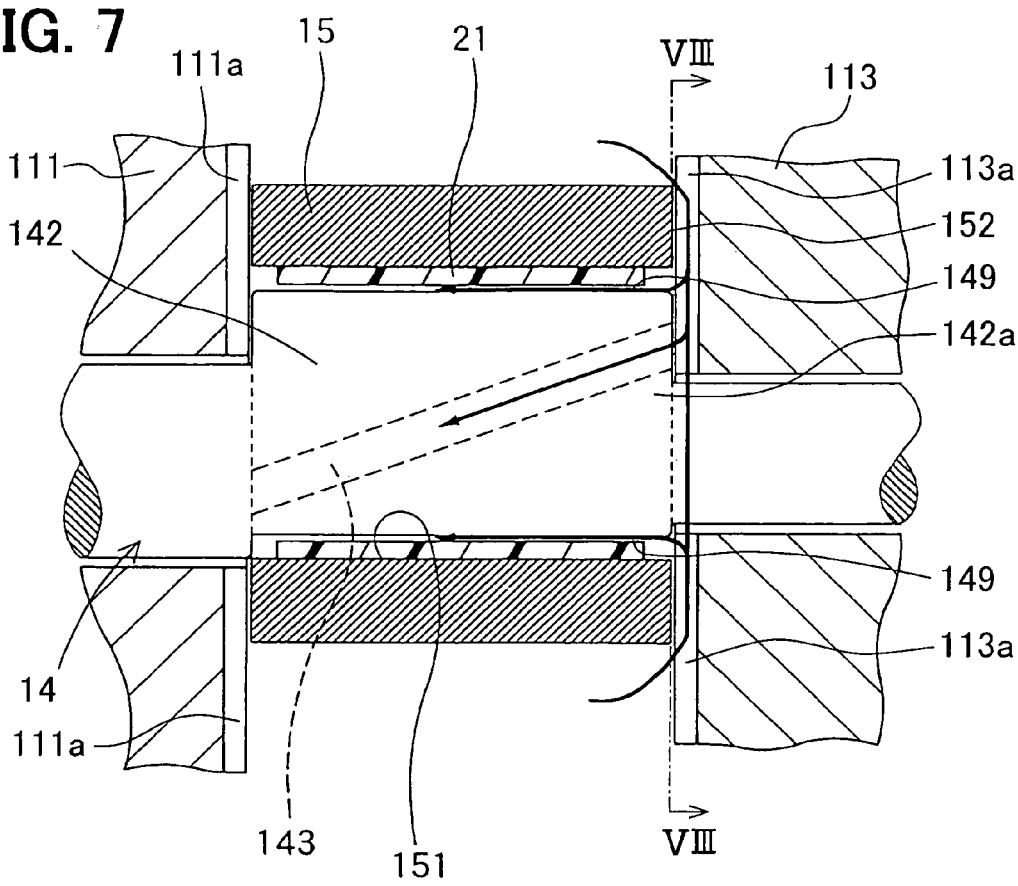
FIG. 7 is a partially cross-sectional front view showing housings, the cam portion and the cam ring according to the third embodiment of the present invention.
Figure 8:
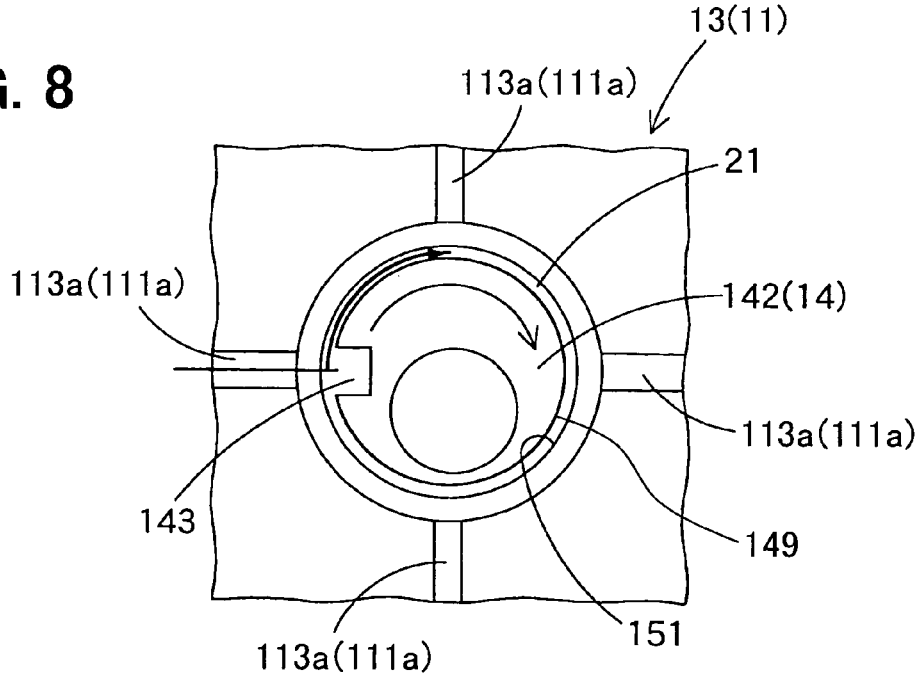
FIG. 8 is a side view showing oil grooves defined in the housing taken along with the line VIII—VIII in FIG. 7 according to the third embodiment.
Figure 9:
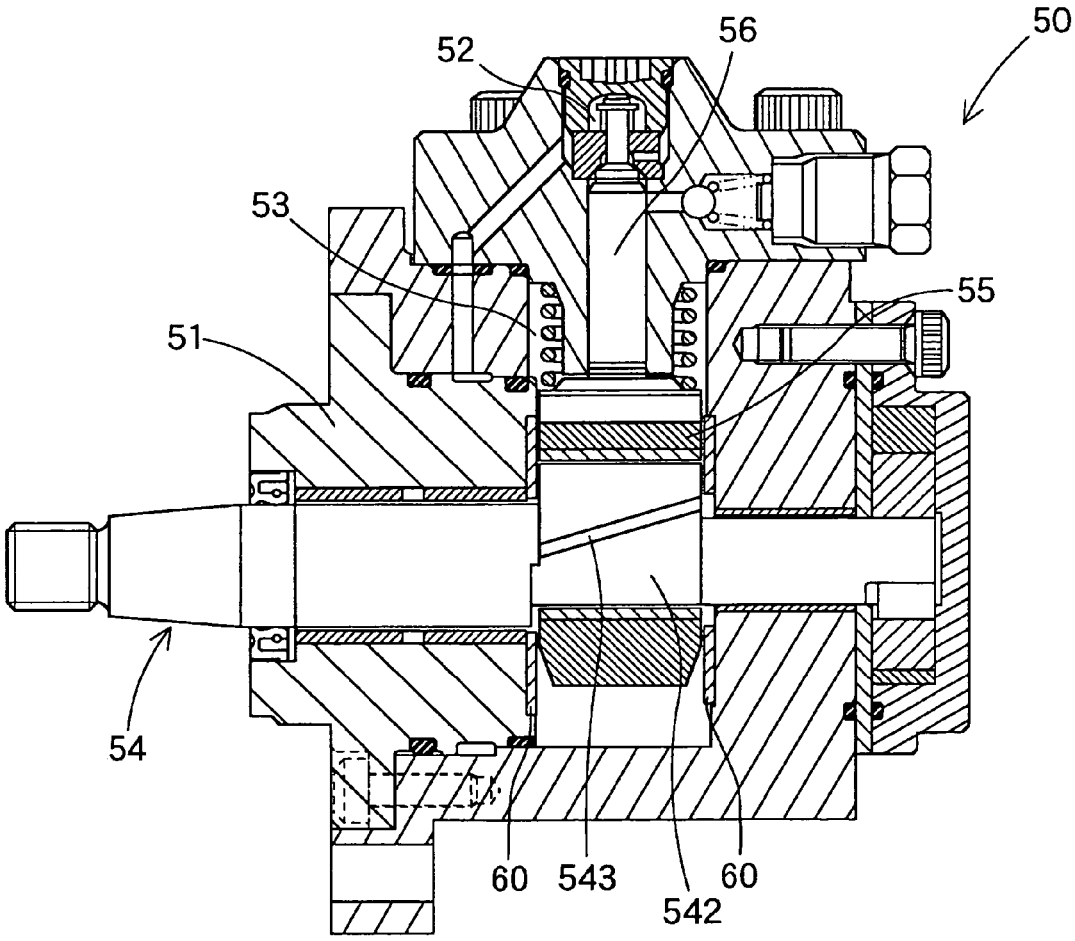
FIG. 9 PRIOR ART
FIG. 9 is a cross sectional front view showing a fuel supply pump according to a prior art.

As shown in FIGS. 7, 8, in this embodiment, the washer members 20 are not provided to the shaft portion 141 of the camshaft 14 in the fuel feed pump, i.e., the camshaft 14 is not axially aligned using the washer members 20. The structure of the fuel supply pump 1 in the third embodiment is substantially the same as the structures of the first and second embodiments, excluding the washer members 20 and oil grooves. In the structure of the third embodiment, cross-shaped grooves 113*a* (FIG. 8) may be defined in the face of the third housing 113, which axially opposes to the corresponding axial end face, i.e., axial end portion 142*a* of the cam portion 142, in the same manner as the oil grooves 203 defined in the washer member 20. Besides, cross-shaped grooves 111*a* may be defined in the face of the first housing 111, which opposes to the corresponding axial end face of the cam portion 142.

The oil grooves 111*a*, 113*a*, which are defined in at least one of the first and third housings 111, 113, are significantly larger than the axial clearance formed between one of the axial end face 152 of the cam ring 15 and one of the first and third housings 111, 113 that axially oppose to each other.

Lubricating oil flowing from the cam chamber 13 is sufficiently supplied to the outer circumferential periphery of the cam portion 142 of the camshaft 14 through the oil grooves 111*a*, 113*a*. Lubricating oil supplied into the oil grooves 111*a*, 113*a* is brought to the gap (engagement gap) 149 between the cam portion 142 and the cam ring 15, as the cam portion 142 of the camshaft 14 rotates. Therefore, seizure may not occur in the periphery of the cam portion 142, so that the fuel supply pump can be protected from seizure.

In the above embodiments, the oil grooves 153, 203, 111*a*, 113*a* are defined in one of the axial end face 152 of the cam ring 15, the washer member 20 and/or the housing 11. The oil grooves 153, 203, 111*a*, 113*a* are oriented toward the center axis of the camshaft 14 in the axial gap formed between the axial end face 152 of the cam ring 15 and the washer member 20 and/or the housing 11. Therefore, lubricating oil is sufficiently supplied into the gap 149, which is formed between the outer circumferential periphery of the cam portion 142 of the camshaft 14 and the inner circumferential periphery of the bearing 21 that engage with each other. Thus, a sufficient amount of lubricating oil can be supplied from the cam chamber 13, so that durability of the fuel supply pump 1 can be enhanced without seizure of the cam portion 142.

The above first to third embodiments can be combined to improve lubricating performance in the fuel supply pump 1.

Various modifications and alternations may be diversely made to the above embodiments without departing from the spirit of the present invention.

What is claimed is:

1. A fuel supply pump that is provided between a fuel tank and a fuel injecting apparatus, the fuel supply pump supplying fuel fed from the fuel tank to the fuel injecting apparatus, the fuel supply pump comprising:

a housing that defines a cam chamber such that lubricating oil is supplied from the cam chamber;

a camshaft that is rotatably supported in the housing, the camshaft including a cam portion that rotates in the cam chamber; and a cam ring that is rotatably connected with the camshaft, wherein the cam ring has an axial end portion that defines an oil groove communicating the cam chamber with a gap, which is substantially circumferentially defined between the cam portion and the cam ring, so that lubricating oil is capable of flowing from the cam chamber into the gap, which is substantially circumferentially defined between the cam portion and the cam ring, through the oil groove.

2. The fuel supply pump according to claim 1, further comprising:

a bearing that is arranged between the cam portion and the cam ring such that the bearing radially outwardly engages with the cam portion, wherein the oil groove communicates the cam chamber with a gap, which is substantially circumferentially defined between the cam portion and the bearing that engage with each other.

3. The fuel supply pump according to claim 1, wherein the oil groove has a substantially linier shape.

4. A fuel supply pump that is provided between a fuel tank and a fuel injecting apparatus, the fuel supply pump supplying fuel fed from the fuel tank to the fuel injecting apparatus, the fuel supply pump comprising:

a housing that defines a cam chamber such that lubricating oil is supplied from the cam chamber;

a camshaft that is rotatably supported in the housing, the camshaft including a cam portion that rotates in the cam chamber; and a cam ring that is rotatably connected with the camshaft, wherein the housing has a face that opposes to an axial end portion of the cam portion in the substantially axial direction of the camshaft, and the face of the housing defines an oil groove that communicates the cam chamber with a gap, which is substantially circumferentially defined between the cam portion and the cam ring, so that lubricating oil is capable of flowing from the cam chamber into the gap, which is substantially circumferentially defined between the cam portion and the cam ring, through the oil groove.

5. The fuel supply pump according to claim 4, wherein the oil groove has a substantially linier shape.

6. A fuel supply pump that is provided between a fuel tank and a fuel injecting apparatus, the fuel supply pump supplying fuel fed from the fuel tank to the fuel injecting apparatus, the fuel supply pump comprising:

a housing that defines a cam chamber such that lubricating oil is supplied from the cam chamber;

a camshaft that is rotatably supported in the housing, the camshaft including a cam portion that rotates in the cam chamber;

a cam ring that is rotatably connected with the camshaft; and a washer member that is provided between an axial end portion of the cam portion and a face of the housing, the face of the housing opposing to the axial end portion of the cam portion in the substantially axial direction of the camshaft, wherein the washer member aligns the camshaft in a thrust direction of the camshaft, and the washer member defines an oil groove that communicates the cam chamber with a gap, which is substantially circumferentially defined between the cam portion and the cam ring, so that lubricating oil is capable of flowing from the cam chamber into the gap, which is substantially circumferentially defined between the cam portion and the cam ring, through the oil groove.

7. The fuel supply pump according to claim 6, wherein the oil groove has a substantially linier shape.

* * * * *